US006668813B2

(12) United States Patent
Azuma et al.

(10) Patent No.: US 6,668,813 B2
(45) Date of Patent: Dec. 30, 2003

(54) AIR-FUEL RATIO CONTROL DEVICE FOR INTERNAL COMBUSTION ENGINE

(75) Inventors: Tadahiro Azuma, Tokyo (JP); Keiichi Enoki, Tokyo (JP); Teruaki Kawakami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/062,444

(22) Filed: Feb. 5, 2002

(65) Prior Publication Data

US 2003/0041848 A1 Mar. 6, 2003

(30) Foreign Application Priority Data

Sep. 3, 2001 (JP) ..... 2001-265664

(51) Int. Cl.[7] ..... F02D 41/00
(52) U.S. Cl. ..... 123/687; 701/109
(58) Field of Search ..... 123/687, 688, 123/672, 681, 674; 701/109, 108, 102; 60/276, 285

(56) References Cited

U.S. PATENT DOCUMENTS 5,172,549 A * 12/1992 Kako ..... 60/276
5,228,286 A * 7/1993 Demura ..... 60/276
5,918,583 A * 7/1999 Fukumasu et al. ..... 123/680
6,018,945 A * 2/2000 Nakagawa ..... 60/285
6,513,509 B1 * 2/2003 Matsumoto ..... 123/674

FOREIGN PATENT DOCUMENTS

JP 5-39741 2/1993

* cited by examiner

*Primary Examiner*—Henry C. Yuen
*Assistant Examiner*—Hyder Ali
(74) *Attorney, Agent, or Firm*—Sughrue Mion, PLLC

(57) ABSTRACT

An air-fuel ratio control device for an internal combustion engine is provided with: an air-fuel ratio sensor; an $O_2$ sensor; a device for setting a reference air-fuel ratio target value; a device for setting a target value of an output value of the $O_2$ sensor; a device for obtaining an air-fuel ratio target value correction value; a device for obtaining a forcible air-fuel ratio oscillation width target value; a device for computing an air-fuel ration target value; a device for computing a correction value; a device for obtaining a forcible air-fuel ratio oscillating width injector driving time correction value; and a device for setting injector driving time.

5 Claims, 9 Drawing Sheets

(a) REFERENCE AIR-FUEL RATIO TARGET VALUE

| ZONE | Z0 | Z1 | Z2 | Z3 | Z4 | Z5 | Z6 | Z7 | Z8 | Z9 |
|---|---|---|---|---|---|---|---|---|---|---|
| L0 | | | | | | | | | | |

(b) FORCIBLE AIR-FUEL RATIO OSCILLATION WIDTH TARGET VALUE

| ZONE | Z0 | Z1 | Z2 | Z3 | Z4 | Z5 | Z6 | Z7 | Z8 | Z9 |
|---|---|---|---|---|---|---|---|---|---|---|
| DAF | | | | | | | | | | |

(c) FORCIBLE AIR-FUEL RATIO OSCILLATION WIDTH INJ DRIVING TIME CORRECTION VALUE

| ZONE | Z0 | Z1 | Z2 | Z3 | Z4 | Z5 | Z6 | Z7 | Z8 | Z9 |
|---|---|---|---|---|---|---|---|---|---|---|
| DINJ | | | | | | | | | | |

(d) FORCIBLE AIR-FUEL RATIO OSCILLATION PERIOD

| Ne | 500 | 1000 | 1500 | ~ | | | | | | 6500 |
|---|---|---|---|---|---|---|---|---|---|---|
| Rn | | | | | | | | | | |
| Ln | | | | | | | | | | |

AIR-FUEL RATIO CONTROL DEVICE FOR INTERNAL COMBUSTION ENGINE

This application is based on Application No. 2001-265664, filed in Japan on Sep. 3, 2001, the contents of which are hereby incorporated by reference.

BACKGROUND OF THE INVENTION

1. Field of the Invention

The present invention relates to an air-fuel ratio control device for an internal combustion engine and particularly concerns an air-fuel ratio control device for an internal combustion engine, by which an air-fuel ratio of air-fuel mixture supplied to the internal combustion engine is controlled so as to efficiently obtain the purifying performance of a catalytic converter.

2. Description of the Related Art

Conventionally, as one of air-fuel ratio control devices of an internal combustion engine, JP-A-H5-39741 discloses the following control device: in an internal combustion engine having a catalytic converter, an air-fuel ratio sensor is provided upstream of the catalytic converter and an $O_2$ sensor is provided downstream of the catalytic converter, an air-fuel ratio on the upstream side is synchronized with the rotation of the internal combustion engine, a forcible oscillation value is reversed to a positive or negative value, a correction coefficient is updated such that a mean air-fuel ratio on the upstream side of the catalytic converter is set at a target air-fuel ratio, the median air-fuel ratio being detected by the air-fuel ratio sensor, when an air-fuel ratio on the downstream side of the catalytic converter is biased to a rich or lean side by the $O_2$ sensor provided downstream of the catalytic converter, a target air-fuel ratio on the upstream side is corrected in a direction of canceling the bias to improve the purifying performance of the catalytic converter, during transient driving such as acceleration and deceleration, in which an irregular air-fuel ratio appears transiently, application of a forcible oscillation signal is prohibited, and degradation in exhausting characteristics is prevented.

However, in a conventional air-fuel ratio control device, forcible oscillation is prohibited only in transient driving, and in the other states forcible oscillation is always applied. Even in a relatively stable condition, an air-fuel ratio after the catalytic converter is biased due to interference such as introduction of purge. In this case (e.g., when being biased to a rich side), when application of forcible oscillation continues, a rich state other than a lean state exists. The lean state is a demanded air-fuel ratio from the state of the catalytic converter. Consequently, optimizing the state of the catalytic converter is interfered, resulting in deterioration in control response. In some cases, exhaust gas may be deteriorated in a rich state of forcible oscillation.

Further, immediately after returning from a fuel cutting state, the catalyst converter enters a state of excessive oxygen, and a purification factor of NOx is considerably reduced relative to a lean state provided upstream of the catalyst converter.

BRIEF SUMMARY OF THE INVENTION

The present invention is devised to solve the above problems and has as its object the provision of an air-fuel ratio control device for an internal combustion engine, by which even in a state other than a transient state, when an $O_2$ sensor provided downstream of a catalyst converter is in a rich state from a first predetermined value or in a lean state from a second predetermined value, periodic forcible oscillation is suspended, and a state for offsetting the biased state of the $O_2$ sensor provided downstream of the catalyst converter is continued until the biased state is ended (until a lean state from the first predetermined value or a rich state from the second predetermined value is provided), so that control can be exercised only in a state required for optimizing the state of the catalyst converter, thereby improving response in control and eliminating the possibility of deteriorating exhaust gas.

Besides, the object of the present invention is to provide an air-fuel ratio control device for an internal combustion engine, by which forcible oscillation after returning to fuel cutting is controlled such that first rich side control time is corrected in an extending direction according to fuel cutting time, so that oxygen of a catalytic converter is consumed and a catalytic converter is immediately brought into a state of a good purification factor.

An air-fuel ratio control device for an internal combustion engine is provided with an air-fuel ratio sensor which is provided upstream of a catalytic converter provided in an exhaust system of the internal combustion engine and detects an air-fuel ratio of the internal combustion engine, an $O_2$ sensor which is provided downstream of the catalytic converter and detects a concentration of oxygen after the catalytic converter, a reference air-fuel ratio target value setting means for setting a reference air-fuel ratio target value based on the number of revolutions and filling efficiency of the internal combustion engine, an $O_2$ voltage target setting means for setting a target value of an output voltage of the $O_2$ sensor based on the number of revolutions and filling efficiency of the internal combustion engine, an air-fuel ratio target value correcting means for obtaining an air-fuel ratio target value correction value based on an output voltage of the $O_2$ sensor and a target value set by the $O_2$ voltage target setting means, a forcible air-fuel ratio oscillation width target value correcting means for obtaining a forcible air-fuel ratio oscillation width target value based on the number of revolutions and filling efficiency of the internal combustion engine, an air-fuel ratio computing means for computing an air-fuel ratio target value based on outputs of the reference air-fuel ratio target value setting means, the air-fuel ratio target value correcting means, and the forcible air-fuel ratio oscillation width target value correcting means, an air-fuel ratio correction value computing means for computing a correction value based on an air-fuel ratio target value computed by the air-fuel ratio target value computing means and an output of the air-fuel ratio sensor, an injector driving time correction value computing means for obtaining a forcible air-fuel ratio oscillation width injector driving time correction value based on the number of revolutions and filling efficiency of the internal combustion engine, and an injector driving time setting means for setting time for driving an injector based on a correction value from the air-fuel ratio correction value computing means and a correction value from the injector driving time correction value computing means.

According to the above configuration, it is possible to exercise control simply by using a state required for optimizing a state of the catalytic converter, improve responsiveness of control, eliminate possibility of deteriorating exhaust gas, and immediately optimize the state of the catalytic converter even in a relatively stable condition.

An air-fuel ratio control device for an internal combustion engine may be characterized in that the forcible air-fuel ratio oscillation width target value correcting means forcibly varies the reference air-fuel ratio target value and the air-fuel ratio target value correction value to a rich side and a lean side in an alternate manner with predetermined widths in synchronization with the rotation of the internal combustion engine.

An air-fuel ratio control device for an internal combustion engine may be characterized in that for the forcible air-fuel ratio oscillation width target value correcting means, a forcible air-fuel ratio oscillation period setting means is provided which sets an air-fuel ratio oscillation period based on the number of revolutions of the internal combustion engine.

An air-fuel ratio control device for an internal combustion engine may be characterized in that for the forcible air-fuel ratio oscillation width target value correcting means, a forcible air-fuel ratio oscillation prohibiting means is provided which prohibits periodic forcible air-fuel ratio oscillation according to an output voltage of the $O_2$ sensor. The forcible air-fuel ratio oscillation prohibiting means prohibits periodic forcible air-fuel ratio oscillation and continues a state for offsetting a detection state of an output voltage of the $O_2$ sensor when an output voltage of the $O_2$ sensor is at a first predetermined value or more or at a second predetermined value or less.

According to the above configuration, it is possible to improve accuracy of control and prevent deterioration of exhust gas.

An air-fuel ratio control device for an internal combustion engine may be characterized in that regarding forcible air-fuel ratio oscillation correction performed after returning to fuel cutting, correcting time of an initial rich side is corrected to an extending side according to fuel cutting time, in the forcible air-fuel ratio oscillation width target value correcting means.

According to the above configuration, it is possible to consume oxygen of the catalytic converter, bring the catalytic converter immediately into a state of a good purification factor, and immediately optimize the state of the catalytic converter.

DETAILED DESCRIPTION OF THE PREFERRED EMBODIMENTS

Hereinafter, embodiments of the present invention will be described in accordance with the accompanied drawings.

Embodiment 1

Figure 1:
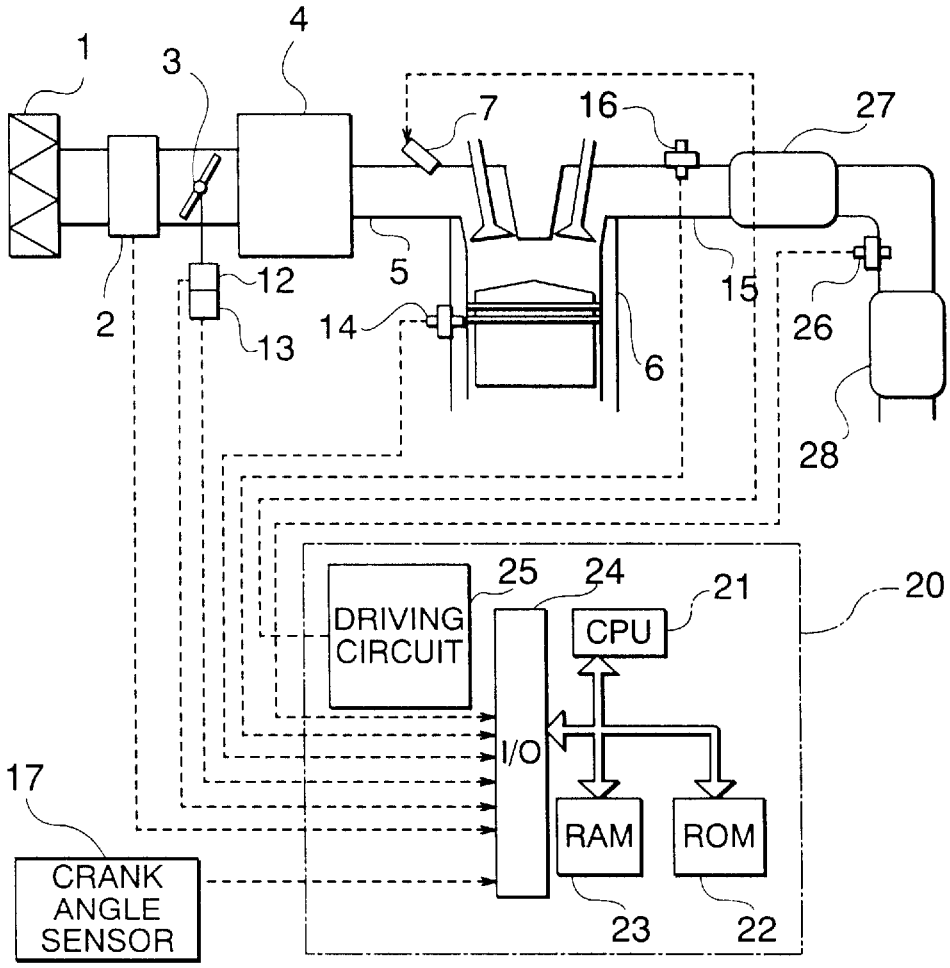
FIG. 1 is a block diagram showing Embodiment 1 of the present invention.

FIG. 1 is a block diagram showing Embodiment 1 of the present invention.

In FIG. 1, as for intake from an air cleaner 1, an intake air quantity Qa is measured by an air flow sensor 2, an intake quantity is controlled by a throttle valve 3 according to a load, and the air is sucked to each cylinder of an engine 6 via a surge tank 4 and an intake pipe 5. Meanwhile, fuel is injected into the intake pipe 5 via an injector 7.

Further, an engine control unit 20 for exercising controls such as air-fuel ratio control and ignition timing control is constituted by a micro computer including a CPU 21, a ROM 22, and a RAM 23, and the engine control unit 20 receives an intake air quantity Qa, which is measured by the air flow sensor 2 via an input/output interface 24, a throttle opening ø detected by the throttle sensor 12, a signal of an idle switch 13, which is turned on during idling opening, an engine cooling water temperature WT detected by a water temperature sensor 14, an air-fuel ratio feedback signal $O_2$ transmitted from an air-fuel ratio sensor 16 provided on an exhaust pipe 15, the number of revolutions Ne of an engine that is detected by a crank angle sensor 17, and so on.

And then, the CPU 21 performs an air-fuel ratio feedback control computation based on control programs and a variety of maps stored in the ROM 22, and drives the injector 7 via a driving circuit 25.

Moreover, catalytic converters 27 and 28 are provided in an exhaust system of the internal combustion engine, and an $O_2$ sensor (hereinafter, referred to as a rear $O_2$ sensor) 26 is provided which is provided downstream of the catalytic converter 27 and detects a concentration of oxygen after the catalytic converter.

Figure 2:
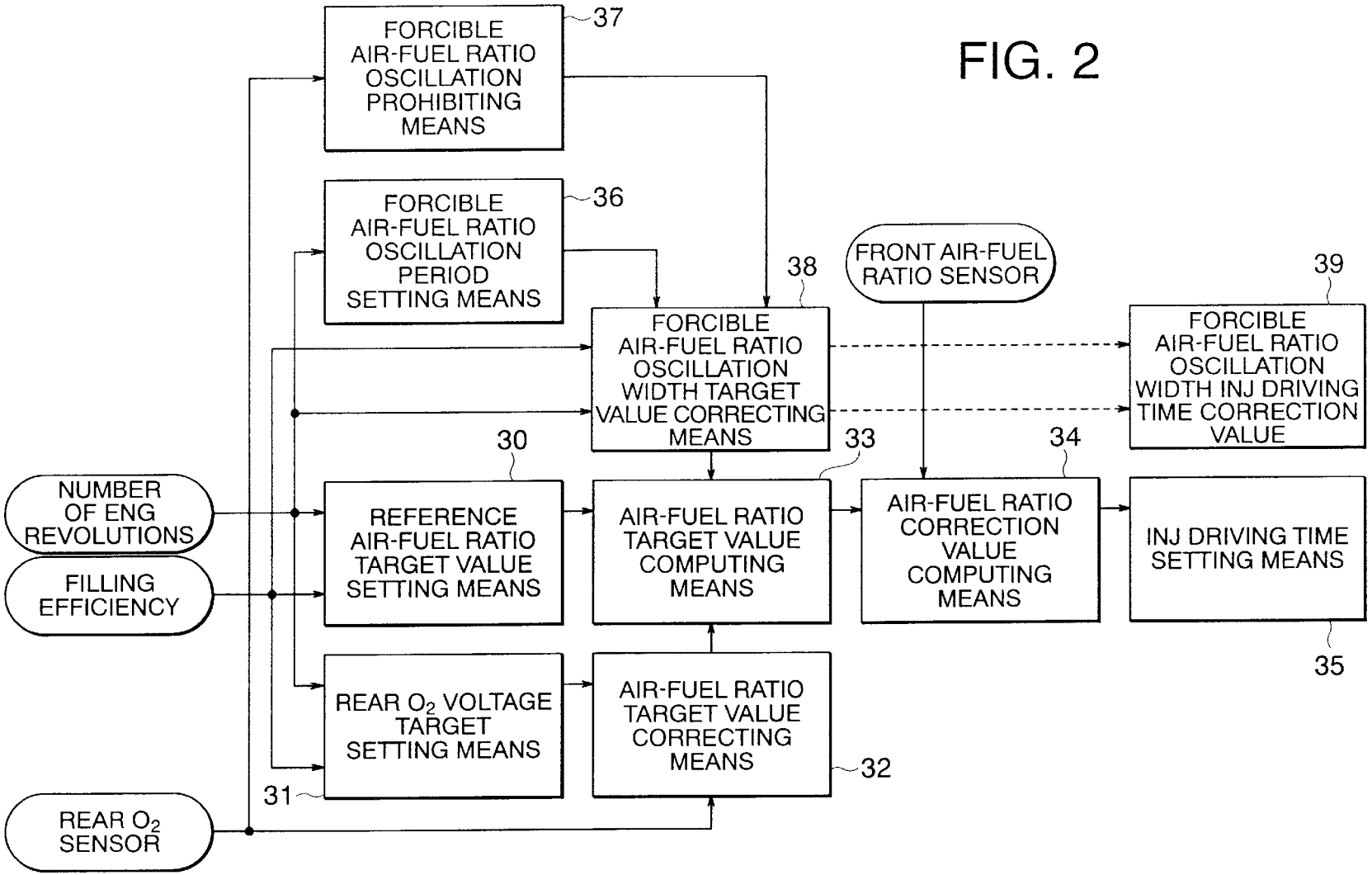
FIG. 2 is a functional block diagram showing Embodiment 1 of the present invention.

FIG. 2 is a block diagram showing the configuration of functions according to Embodiment 1 of the present invention.

In FIG. 2, reference numeral 30 denotes a reference air-fuel ratio target value setting means that obtains a reference air-fuel ratio target value based on the number of revolutions of an engine (ENG) and filling efficiency. The reference air-fuel ratio target value will be discussed in FIG. 8(*a*). Reference numeral 31 denotes a rear $O_2$ voltage target value setting means that obtains a rear $O_2$ voltage target value based on the number of ENG revolutions and filling efficiency. Reference numeral 32 denotes an air-fuel ratio target value correcting means that obtains an air-fuel ratio target value correction value (air-fuel ratio target value integral correction value, air-fuel ratio target value proportional correction value) based on a rear $O_2$ sensor output voltage and a rear $O_2$ voltage target value, which is set by the rear $O_2$ voltage target value setting means 31.

Next, as a means for forcibly oscillating an air-fuel ratio, reference numeral 36 denotes a forcible air-fuel ratio oscillation period setting means that obtains a period of air-fuel ratio oscillation based on the number of ENG revolutions, and reference numeral 38 denotes a forcible air-fuel ratio oscillation width target value correcting means that obtains a forcible air-fuel ratio oscillation width target value based on the number of ENG revolutions and filling efficiency. As will be discussed later, a forcible air-fuel ratio oscillation prohibiting means 37 may be provided for prohibiting periodic forcible air-fuel ratio oscillation in accordance with the state of rear $O_2$. An air-fuel ratio target value is computed by an air-fuel ratio target value computing means 33 based on the outputs of the reference air-fuel ratio target value setting means 30, the air-fuel ratio target value correcting means 32, and the forcible air-fuel ratio oscillation width target value correcting means 38.

Subsequently, a correction value is computed by an air-fuel ratio correction value computing means 34 such that an air-fuel ratio target value from the air-fuel ratio target value computing means 33 and an output from a front air-fuel ratio sensor, that is, the air-fuel ratio sensor 16 may coincide. Driving time for driving the injector 7 is set by an INJ driving time setting means 35 based on the correction value and a forcible air-fuel ratio oscillation width INJ driving time correction value 39, which is obtained from the number of ENG revolutions and filling efficiency.

Next, the operations will be discussed.

Figure 3:
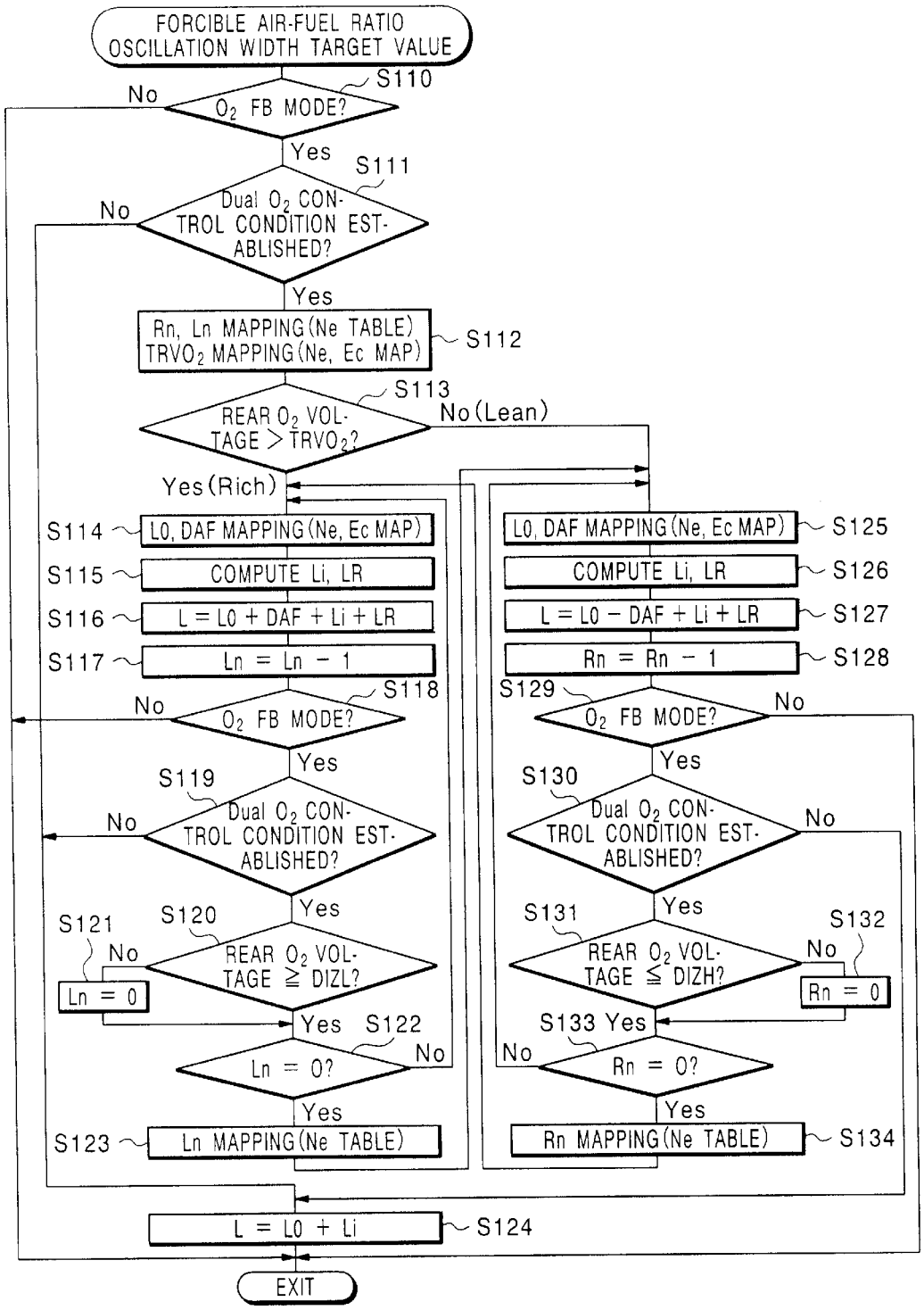
FIG. 3 is a flowchart for forcibly oscillating a target value of Embodiment 1 of the present invention.

FIG. 3 is a flowchart for setting a forcible air-fuel ratio oscillation width target value. Referring to FIG. 3, the following will discuss setting of a forcible air-fuel ratio oscillation width target value.

First, in step S110, determination is made if a mode is an $O_2$FB (feedback) mode or not. When a mode is not the $O_2$FB mode, the flow goes to EXIT, and when a mode is the $O_2$FB mode, the flow goes to step S111. In step S111, determination is made if a condition of Dual$O_2$ control is established or not.

Here, the Dual$O_2$ control refers to a part constituted by the air-fuel ratio sensor 16, which is provided upstream of the catalyst converter 27 provided in the exhaust system of the internal combustion engine and detects an air-fuel ratio of the internal combustion engine, the $O_2$ sensor (hereinafter, referred to as a rear $O_2$ sensor) 26, which is provided downstream of the catalytic converter 27 and detects a concentration of oxygen after the catalytic converter, the reference air-fuel ratio target value setting means 30 for setting a target value of an air-fuel ratio of the internal combustion engine, the rear $O_2$ voltage target setting means 31 for setting a target of an output voltage of the rear $O_2$ sensor 26, and the air-fuel ratio target value correcting means 32 which obtains an air-fuel ratio target value correction value for correcting a reference air-fuel ratio target value such that a rear $O_2$ sensor voltage is equal to a rear $O_2$ voltage target value.

Further, reference characters of the flowchart denote as follows:

L: air-fuel ratio target value

L0: reference air-fuel ratio target value

Li: air-fuel ratio target value integral correction value (part of output of the air-fuel ratio target value correcting means)

LR: air-fuel ratio target value proportional correction value (part of output of the air-fuel ratio target value correcting means)

$TRVO_2$: rear $O_2$ voltage target value

In step S111, when Dual $O_2$ control is not established, an air-fuel ratio target value L is set at L0+Li in step S124 and the flow proceeds to EXIT. Moreover, when the condition is established, the flow proceeds to step S112 and mapping is performed on a rich side forcible air-fuel ratio oscillation period Rn, a lean side forcible air-fuel ratio oscillation period Ln, and a rear $O_2$ target voltage $TRVO_2$ based on the number of revolutions of the engine and filling efficiency.

Subsequently, the flow proceeds to step S113, and a rear $O_2$ voltage and a rear $O_2$ voltage target value are compared with each other. When a rear $O_2$ voltage is larger than a target voltage (rich state), the flow proceeds to the step S114.

Next, in step S114, mapping is performed on L0 and a forcible air-fuel ratio oscillation width target value DAF, and the flow proceeds to the next step S115. In step S115, Li and LR are computed based on the computation of Li and LR, that will be discussed later. In the next step S116, an air-fuel ratio target value L is computed, which is biased to a lean state by DAF from ordinary control, based on L0 and DAF mapped in step S114 and Li and LR computed in step S115. In the next step S117, a lean side forcible air-fuel ratio oscillation period counter is subtracted by 1.

In the next steps S118 and S119, confirmation is made again if a mode is an $O_2$FB mode or if Dual$O_2$ control is established. When the condition is not established, the same operations are performed as steps S100 and S111. Meanwhile, when the condition is established, a rear $O_2$ voltage and a rear $O_2$ lean state determining voltage DIZL (first predetermined value) are compared with each other instep S120. When a rear $O_2$ voltage is DIZL or more, the flow proceeds to step S122 and comparison is made if a counter Ln is 0 or not. When the counter Ln is not 0, the flow returns to step S114 and the above-mentioned operations are performed again and are repeated until the counter Ln is set at 0.

During repetition, when a rear $O_2$ voltage is below DIZL in step S120, since a lean state is not necessary, the flow proceeds to step S121 and the counter Ln is set at 0, namely, periodic forcible air-fuel ratio oscillation is prohibited by the forcible air-fuel ratio oscillation prohibiting means 37, Ln is mapped in step S123 after in step S122, and the flow proceeds to step S125.

Besides, as for the operations from step S125 to step S134, the same operations are performed in a state in which a rich state and a lean state of an air-fuel ratio in steps S114 to S123 are reversed. In the above series of operations, an air-fuel ratio target value can be forcibly oscillated to a rich side and a lean side by DAF at predetermined periods. In this case, the condition is established in step S130, and a rear $O_2$ lean state determining voltage DIZH, which is compared with a rear $O_2$ voltage in step S131, is a second predetermined value.

Figure 4:
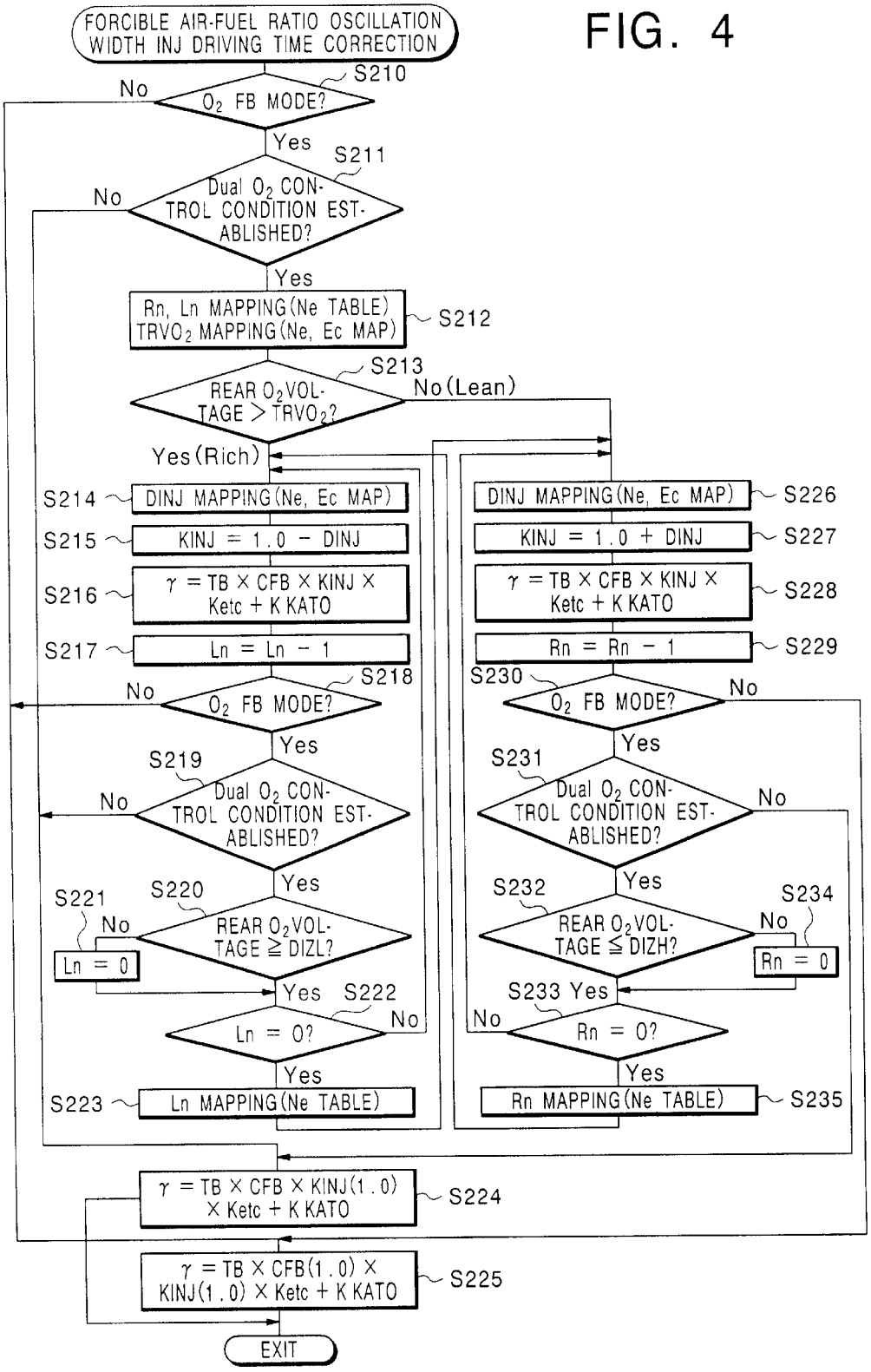
FIG. 4 is a flowchart for forcibly oscillating INJ driving time that is performed simultaneously with the forceful oscillation of a target value of FIG. 3.

FIG. 4 is a flowchart for setting a forcible air-fuel ratio oscillation width INJ driving time correction value. Referring to FIG. 4, the following will discuss setting of a forcible air-fuel ratio oscillation width INJ driving time correction value.

First, in step S210, determination is made if a mode is an $O_2$FB mode or not. When a mode is not an $O_2$FB mode, the flow proceeds to step S225, INJ driving time is computed while a forcible air-fuel ratio oscillation INJ driving time correction coefficient KINJ is set at 1.0, and the flow proceeds to EXIT. When a mode is an $O_2$FB mode, the flow proceeds to step S211.

In step S211, determination is made if a Dual$O_2$ control condition is established or not. When Dual$O_2$ control is not established in step S211, a forcible air-fuel ratio oscillation INJ driving time correction coefficient KINJ is set at 1.0 in step S224, INJ driving time is computed, and the flow proceeds to EXIT. When the condition is established, the flow proceeds to step S212, and mapping is performed on a rich side forcible air-fuel ratio oscillation period Rn, a lean side forcible air-fuel ratio oscillation period Ln, and a rear $O_2$ target voltage TRV$O_2$ based on the number of revolutions of the engine and filling efficiency.

Next, the flow proceeds to step S213, and a rear $O_2$ voltage and a rear $O_2$ voltage target value are compared with each other. When a rear $O_2$ voltage is larger than a target voltage (rich state), the flow proceeds to step S214. And then, a forcible air-fuel ratio oscillation INJ driving time correction value DINJ is mapped in step S214, and KINJ is computed based on DINJ in step S215 (injector driving time correction value computing means). In the next step S216, INJ driving time is computed which is biased to a lean state by DINJ from ordinary control based on DINJ computed in step S215.

In the next step S217, a lean side forcible air-fuel ratio oscillation period counter is subtracted by 1. In the next steps S218 and S219, confirmation is made again if a mode is an $O_2$FB mode or if Dual$O_2$ control is established. When the condition is not established, the same operations are performed as steps S210 and S211. Meanwhile, when the condition is established, a rear $O_2$ voltage and a rear $O_2$ lean state determining voltage DIZL are compared with each other in step S220. When a rear $O_2$ voltage is at DIZL or more, the flow proceeds to step S222 and comparison is made if a counter Ln is 0 or not. When the counter Ln is not 0, the flow returns to step S214 and the above same operations are performed and are repeated until the counter Ln is set at 0.

During repetition, when a rear $O_2$ voltage is below DIZL in step S220, since a lean state is not necessary, the flow proceeds to step S221, the counter Ln is set at 0, Ln is mapped in step S223 after step S222, and the flow proceeds to step S226. As for the operations from step S226 to step S235, the same operations are performed in a state in which a rich state and a lean state of an air-fuel ratio of steps S214 to S223 are reversed. In the above series of operations, INJ driving time can be forcibly oscillated to a rich side and a lean side by DINJ at predetermined periods.

Figure 5:
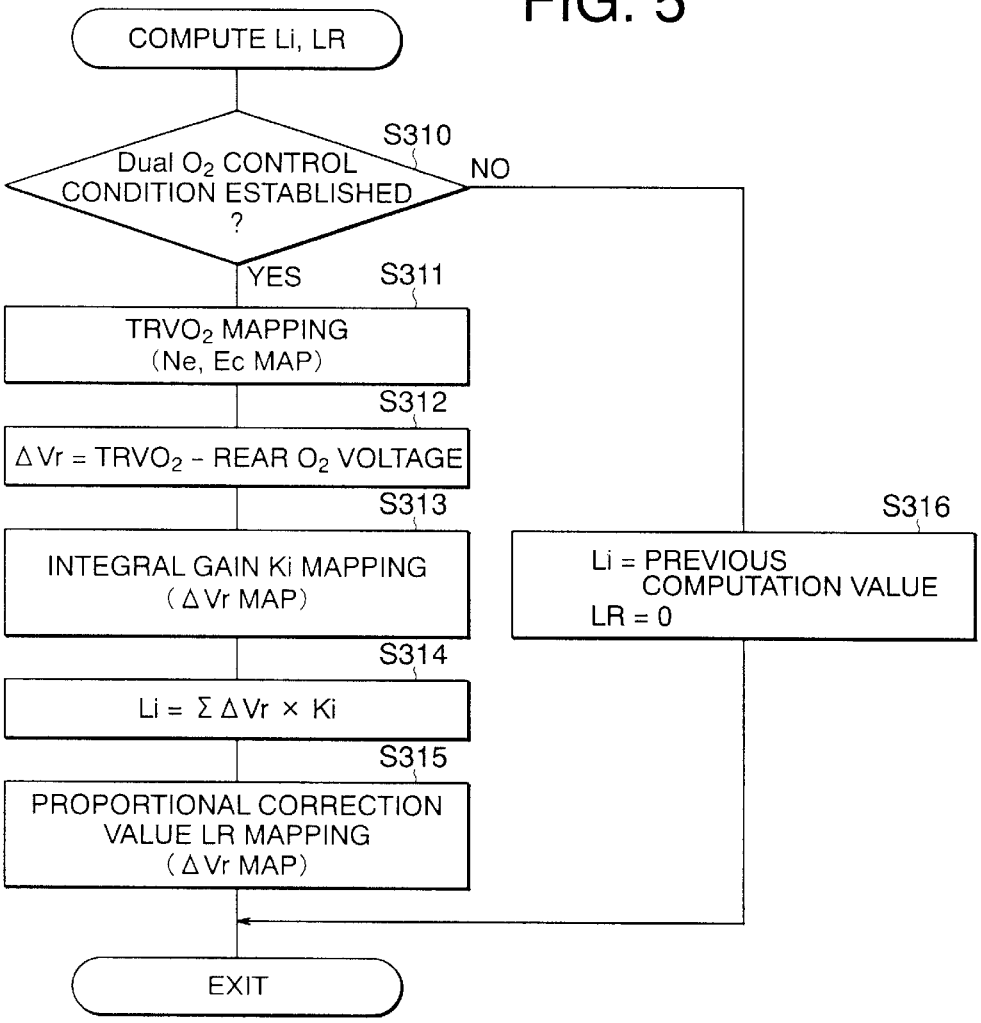
FIG. 5 is a flowchart for correcting a reference air-fuel ratio target value according to Embodiment 1 of the present invention.

FIG. 5 is a flowchart for computing Li and LR in the flowchart of FIG. 3. Referring to FIG. 5, Li and LR will be discussed by calculation.

First, in step S310, determination is made if a Dual$O_2$ control condition is established or not. When the condition is not established, in step S316, Li is set at the previous computation value, LR is set at 0, and the flow is ended. Meanwhile, when the Dual$O_2$ condition is established, the flow proceeds to step S311 and TRV$O_2$ is mapped. In the next step S312, a deviation from a rear $O_2$ voltage is obtained to compute ΔVr.

In the next step S313, an integral gain Ki is mapped according to ΔVr based on an integral gain table of FIG. 6(*a*) that will be discussed later. In the next step S314, the product of ΔVr and Ki is integrated to compute an integral correction coefficient Li. Moreover, in the next step S315, a value is mapped according to the ΔVr based on a proportional correction value table of FIG. 6(*b*). Li and LR are computed by the above operations under Dual$O_2$ control.

Figure 6:
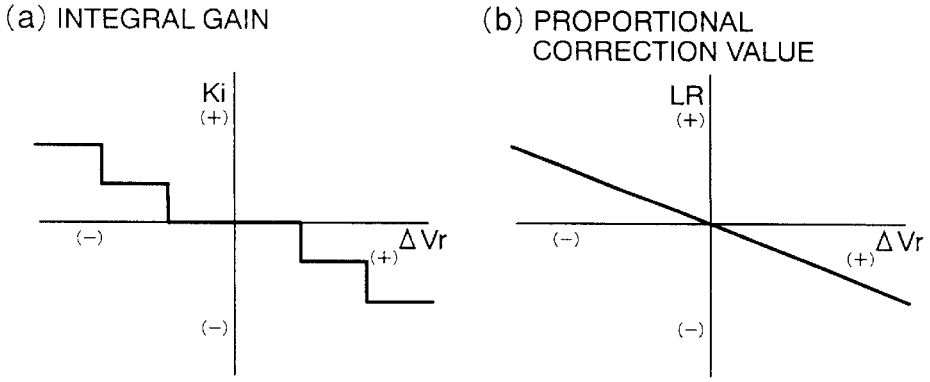
FIG. 6 is a graph showing an integral gain and a proportional correction value that are obtained for computing a correction value of a reference air-fuel ratio target value according to Embodiment 1 of the present invention.

FIG. 6 is a graph showing an integral gain and a proportional correction value that are used in the flowchart of FIG. 5. An integral gain and a proportional correction value are both shown in tables of ΔVr. The tables are configured as follows: when ΔVr is negative, namely, when the state of a catalyst is rich, a value is obtained in a direction for setting an air-fuel ratio target value at a lean state. When ΔVr is positive, namely, when the state of the catalyst is lean, a value is obtained in a direction for setting an air-fuel ratio target value at a rich state.

Figures 7, 8:
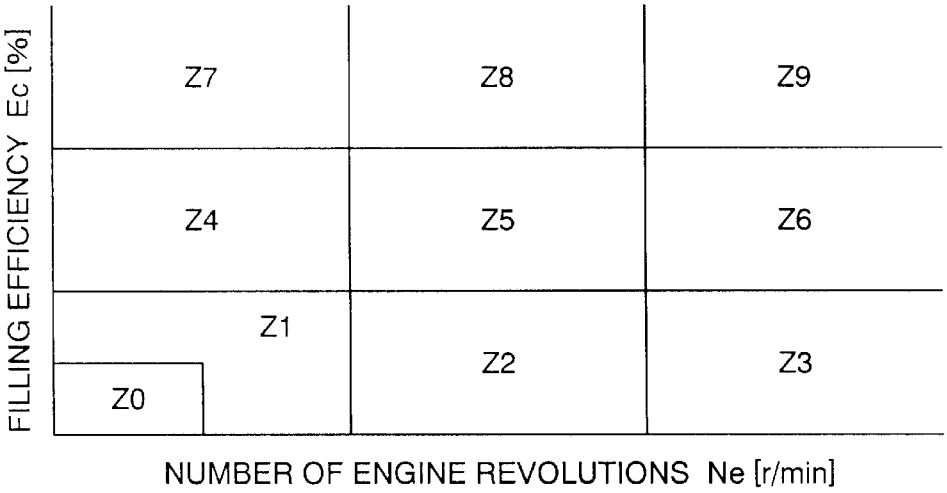
FIG. 7 is a divided table showing a reference air-fuel ratio target value, a forcible air-fuel ratio oscillation width target value, and a forcible air-fuel ratio oscillation width INJ driving time correction value according to Embodiment 1 of the present invention.
FIG. 8 is a diagram showing tables of a reference air-fuel ratio target value, a forcible air-fuel ratio oscillation width target value, a forcible air-fuel ratio oscillation width INJ driving time correction value, and a forcible air-fuel ratio oscillation period according to Embodiment 1 of the present invention.

FIG. 7 shows zones of table axes regarding (a) a reference air-fuel ratio target value, (b) a forcible air-fuel ratio oscillation width target value, and (c) a forcible air-fuel ratio oscillation width INJ driving time correction value of FIG. 8 that will be discussed later. The zones are determined by the number of revolutions of the engine and filling efficiency.

FIG. 8 shows tables for setting (a) a reference air-fuel ratio target value, that is, a reference value of a target air-fuel ratio provided upstream of the catalyst, (b) a forcible air-fuel ratio variation width target value, that is, a target value oscillation width during forcible oscillation control, (c) a forcible air-fuel ratio oscillation width INJ driving time correction value, that is, an INJ driving time correction width, and (d) a forcible air-fuel ratio oscillation period. A reference value of a target air-fuel ratio, a target value oscillation width during forcible oscillation control, and an INJ driving time correction width are shown in tables corresponding to the zones of FIG. 7. A table for setting a forcible air-fuel ratio oscillation period is a table indicating the number of revolutions of the engine.

In this manner, according to the present embodiment, when an air-fuel ratio is biased to a rich side or a lean side after the catalyst converter, forcible air-fuel ratio oscillation is prohibited and a state of an air-fuel ratio is continued in a direction for offsetting the bias, thereby immediately bringing the catalyst converter into an optimum state.

Embodiment 2

Figure 9:
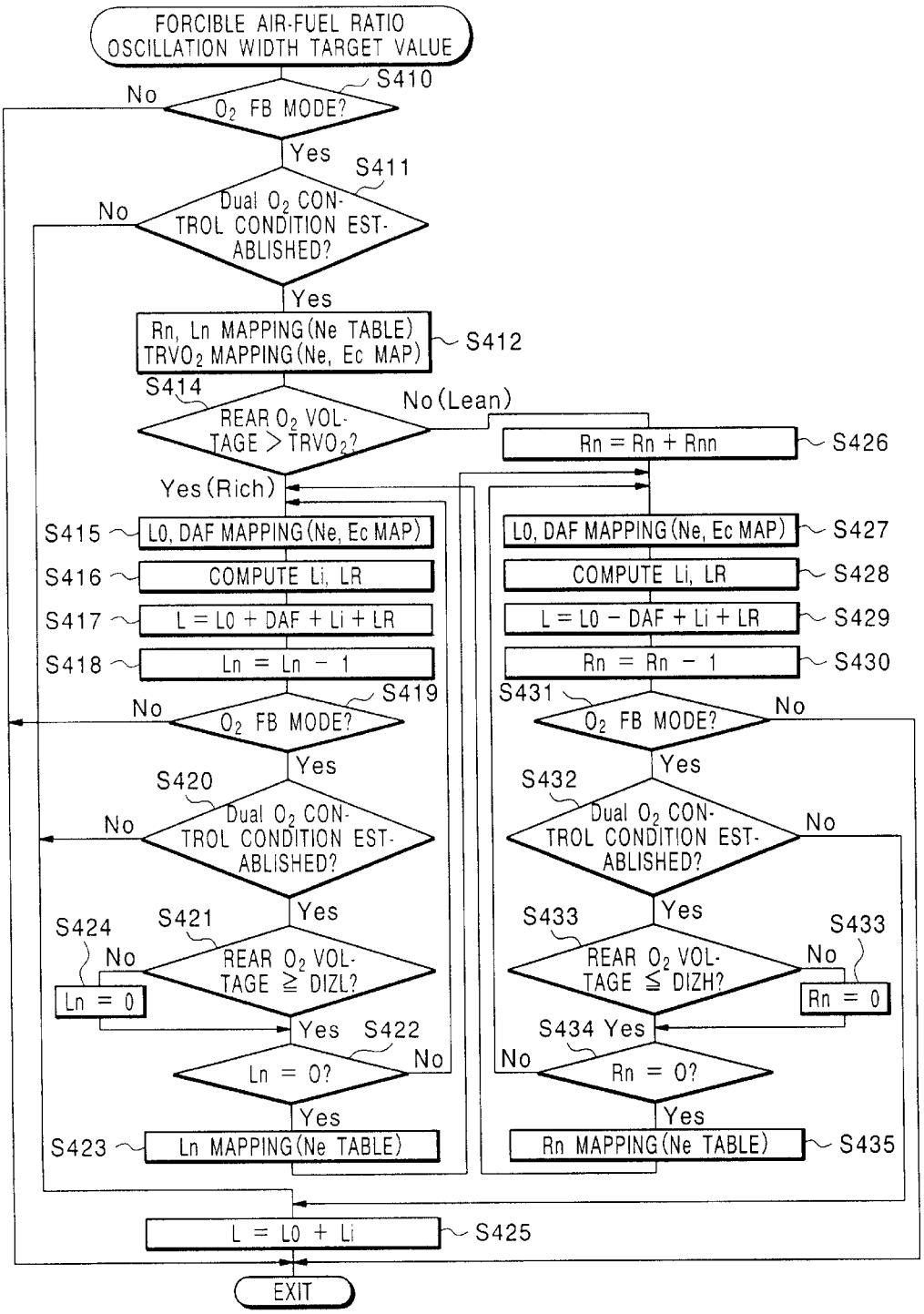
FIG. 9 is a flowchart for forcibly oscillating a target value that includes a rich-side continuous operation of forcible air-fuel ratio oscillation after cutting fuel according to Embodiment 2 of the present invention.

FIG. 9 is a flowchart for setting a forcible air-fuel ratio oscillation width target value in Embodiment 2 of the present invention. Besides, since the present embodiment is substantially identical to Embodiment 1 in circuit configuration, the description thereof is omitted.

The basic operations are substantially the same as setting of a forcible air-fuel ratio oscillation width target shown in FIG. 3 of Embodiment 1. The difference is that when NO (Lean) is selected in step S414, a rich side forcible air-fuel ratio oscillation period counter Rn is extended in the next step S426 by a post-F/C rich period extending counter Rnn, which performs mapping according to F/C time. The catalyt normally adsorbs oxygen to a full capacity during F/C. After returning to F/C, NOx is likely to be generated in a lean state. Therefore, since a quantity of adsorbed oxygen is immediately brought into a suitable state by extending a rich state after an F/C state, it is possible to suppress the generation of NOx in a lean state.

Figure 10:
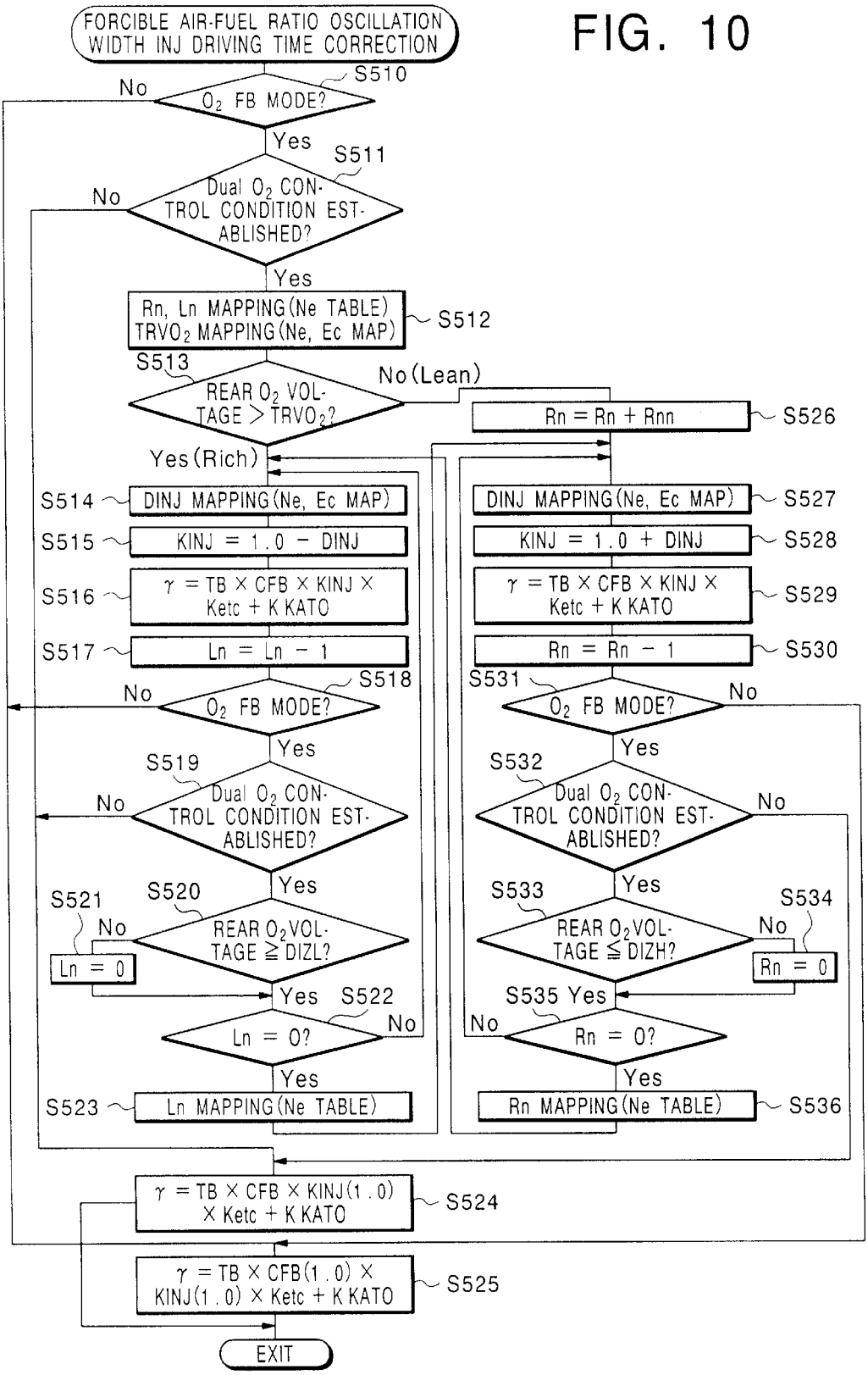
FIG. 10 is a flowchart for forcibly oscillating INJ driving time that is performed simultaneously with forceful oscillation of a target value of FIG. 8.

FIG. 10 is a flowchart for setting a forcible air-fuel ratio oscillation width INJ driving time correction value. The basic operations thereof are the same as the correction of forcible air-fuel ratio oscillation width INJ driving time that is shown in FIG. 4 of Embodiment 1. The difference is the same as that of FIG. 9, and the effect is also the same as that of FIG. 9.

Figure 11:
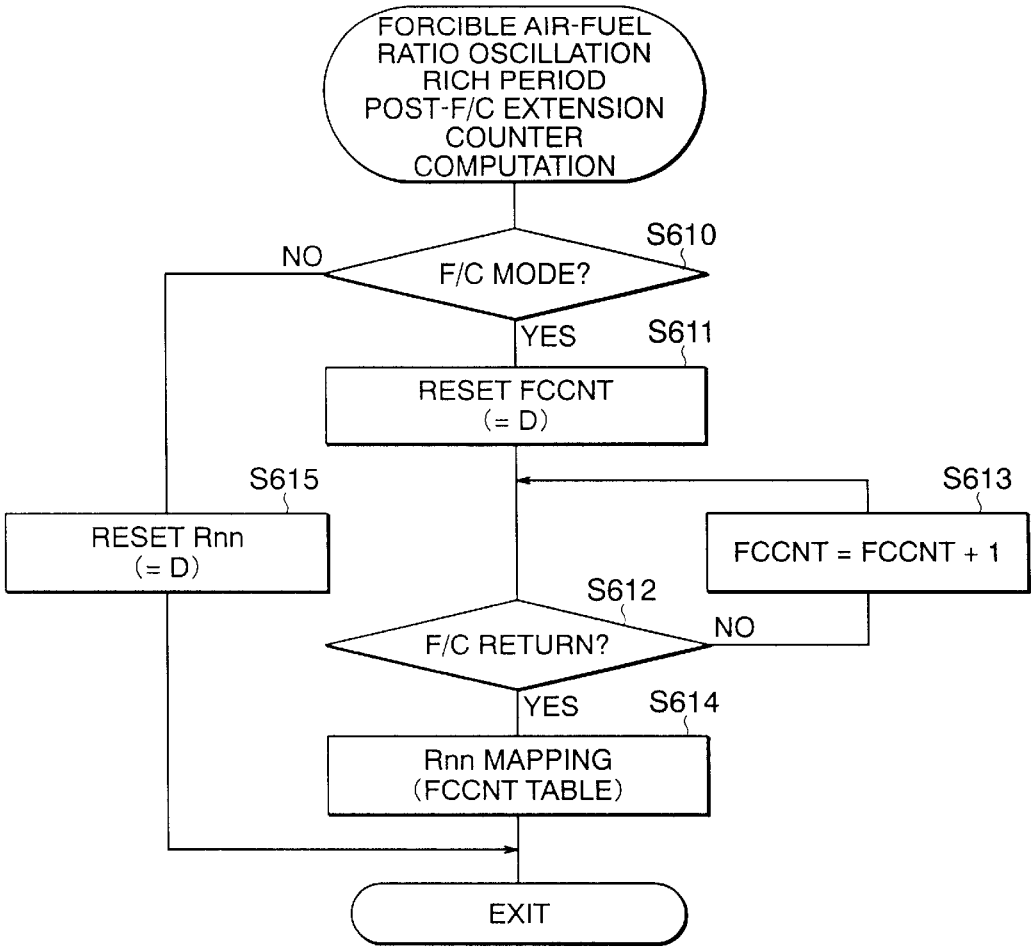
FIG. 11 is a flowchart showing a computation of a forcible air-fuel ratio oscillation rich-period fuel cutting post-extension counter according to Embodiment 2 of the present invention.

FIG. 11 is a flowchart for computing a forcible air-fuel ratio oscillation rich period post-fuel cutting extension counter. Referring to FIG. 11, the following will discuss a computation of a forcible air-fuel ratio oscillation rich period post-F/C extension counter.

In step S610, determination is made if a mode is an F/C mode or not. When a mode is not an F/C mode, the counter does not need to be extended. Thus, Rnn is reset (=0) in step S615. Meanwhile, in the case of an F/C mode, an F/C time counter FCCNT is reset in step S611. Next, in step S612, determination is made if F/C return is made or not. When a mode is an F/C mode, the flow proceeds to step S613 and FCCNT is added by 1.

Thereafter, in steps S612 and S613, FCCNT is added by 1 (+1) and F/C duration is counted until F/C return is made. And then, when F/C return is found in step S612, the flow proceeds to step S614. A count value of the post-F/C rich period extension counter Rnn is mapped according to an F/C duration FCCNT based on a post-F/C rich period extension counter table of FIG. 12.

Figure 12:
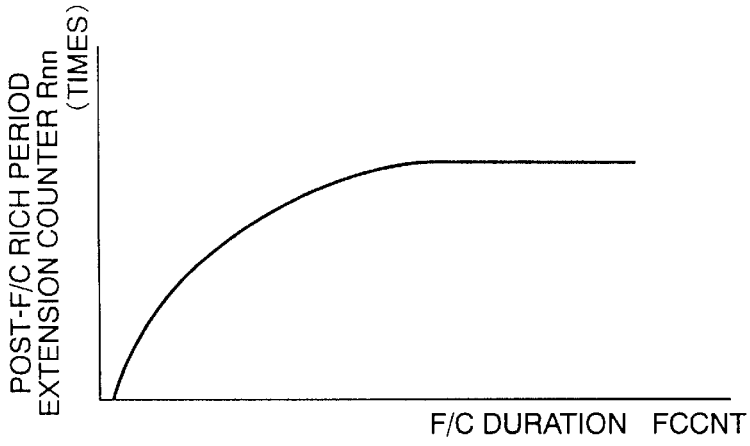
FIG. 12 is a graph showing the relationship between fuel cutting duration and a post-fuel cutting rich period extension counter according to Embodiment 2 of the present invention.

FIG. 12 is a graph showing the relationship between fuel cutting time and a post-fuel cutting rich period extension counter value. The relationship is characterized in that as F/C duration is longer, a counted value of the post-F/C rich period extension counter Rnn is increased, and when F/C duration is at a predetermined value or more, the extension counter Rnn remains constant.

In this manner, according to the present embodiment, after returning to fuel cutting, a control period on a rich side is extended, thereby immediately optimizing the state of the catalytic converter.

What is claimed is:

1. An air-fuel ratio control device for an internal combustion engine, comprising:

an air-fuel ratio sensor which is provided upstream of a catalytic converter provided in an exhaust system of said internal combustion engine and detects an air-fuel ratio of said internal combustion engine;

an $O_2$ sensor which is provided downstream of said catalytic converter and detects a concentration of oxygen after said catalytic converter;

reference air-fuel ratio target value setting means for setting a reference air-fuel ratio target value based on the number of revolutions and filling efficiency of said internal combustion engine;

$O_2$ voltage target setting means for setting a target value of an output voltage of said $O_2$ sensor based on the number of revolutions and filling efficiency of said internal combustion engine;

air-fuel ratio target value correcting means for obtaining an air-fuel ratio target value correction value based on an output voltage of said $O_2$ sensor and a target value set by said $O_2$ voltage target setting means;

forcible air-fuel ratio oscillation width target value correcting means for obtaining a forcible air-fuel ratio oscillation width target value used for forcible air-fuel ratio oscillation based on the number of revolutions and filling efficiency of said internal combustion engine;

air-fuel ratio computing means for computing an air-fuel ratio target value based on outputs of said reference air-fuel ratio target value setting means, said air-fuel ratio target value correcting means, and said forcible air-fuel ratio oscillation width target value correcting means;

air-fuel ratio correction value computing means for computing a correction value based on an air-fuel ratio target value computed by said air-fuel ratio target value computing means and an output of said air-fuel ratio sensor;

injector driving time correction value computing means for obtaining a forcible air-fuel ratio oscillation width injector driving time correction value based on the number of revolutions and filling efficiency of said internal combustion engine; and injector driving time setting means for setting time for driving an injector based on a correction value from said air-fuel ratio correction value computing means and a correction value from said injector driving time correction value computing means, wherein a forcible air-fuel ratio oscillation prohibiting means prohibits forcible air-fuel ratio oscillation when the output voltage of said $O_2$ sensor is below a predetermined value.

2. The air-fuel ratio control device for the internal combustion engine according to claim 1, wherein said forcible air-fuel ratio oscillation width target value correcting means forcibly varies said reference air-fuel ratio target value and said air-fuel ratio target value correction value to a rich side and a lean side in an alternate manner with predetermined widths in synchronization with rotation of said internal combustion engine.

3. The air-fuel ratio control device for the internal combustion engine according to claim 1, further comprising forcible air-fuel ratio oscillation period setting means, which sets an air-fuel ratio oscillation period based on the number of revolutions of said internal combustion engine, for said forcible air-fuel ratio oscillation width target value correcting means.

4. The air-fuel ratio control device for the internal combustion engine according to claim 1, further comprising forcible air-fuel ratio oscillation prohibiting means, which prohibits periodic forcible air-fuel ratio oscillation according to an output voltage of said $O_2$ sensor, for said forcible air-fuel ratio oscillation width target value correcting means, said forcible air-fuel ratio oscillation prohibiting means prohibiting periodic forcible air-fuel ratio oscillation and continuing a state for offsetting a detection state of an output voltage of said $O_2$ sensor when an output voltage of said $O_2$ sensor is at a first predetermined value or more or at a second predetermined value or less.

5. The An air-fuel ratio control device for the internal combustion engine comprising:

an air-fuel ratio sensor which is provided upstream of a catalytic converter provided in an exhaust system of said internal combustion engine and detects an air-fuel ratio of said internal combustion engine;

an $O_2$ sensor which is provided downstream of said catalytic converter and detects a concentration of oxygen after said catalytic converter;

reference air-fuel ratio target value setting means for setting a reference air-fuel ratio target value based on the number of revolutions and filling efficiency of said internal combustion engine;

$O_2$ voltage target setting means for setting a target value of an output voltage of said $O_2$ sensor based on the number of revolutions and filling efficiency of said internal combustion engine;

air-fuel ratio target value correcting means for obtaining an air-fuel ratio target value correction value based on an output voltage of said $O_2$ sensor and a target value set by said $O_2$ voltage target setting means;

forcible air-fuel ratio oscillation width target value correcting means for obtaining a forcible air-fuel ratio oscillation width target value based on the number of revolutions and filling efficiency of said internal combustion engine;

air-fuel ratio computing means for computing an air-fuel ratio target value based on outputs of said reference air-fuel ratio target value setting means, said air-fuel ratio target value correcting means, and said forcible air-fuel ratio oscillation width target value correcting means;

air-fuel ratio correction value computing means for computing a correction value based on an air-fuel ratio target value computed by said air-fuel ratio target value computing means and an output of said air-fuel ratio sensor;

injector driving time correction value computing means for obtaining a forcible air-fuel ratio oscillation width injector driving time correction value based on the number of revolutions and filling efficiency of said internal combustion engine; and injector driving time setting means for setting time for driving an injector based on a correction value from said air-fuel ratio correction value computing means and a correction value from said injector driving time correction value computing means, wherein regarding forcible air-fuel ratio oscillation correction performed after returning to fuel cutting, correcting time of an initial rich side is corrected to an extending side according to fuel cutting time, in said forcible air-fuel ratio oscillation width target value correcting means.

* * * * *